US008482216B1

(12) United States Patent
North

(10) Patent No.: US 8,482,216 B1
(45) Date of Patent: Jul. 9, 2013

(54) SYSTEM AND METHOD FOR UNIFORM CONTROL OF CURRENT REGULATED OUTPUTS OVER WIDE VOLTAGE RANGES

(75) Inventor: Brian B. North, Los Gatos, CA (US)

(73) Assignee: Kinetic Technologies, Inc., Sunnyvale, CA (US)

( * ) Notice: Subject to any disclaimer, the term of this patent is extended or adjusted under 35 U.S.C. 154(b) by 528 days.

(21) Appl. No.: 12/730,894

(22) Filed: Mar. 24, 2010

Related U.S. Application Data

(60) Provisional application No. 61/165,671, filed on Apr. 1, 2009.

(51) Int. Cl.
*H05B 37/02* (2006.01)

(52) U.S. Cl.
USPC ..... 315/291; 315/307; 315/308

(58) Field of Classification Search
USPC ..... 315/291, 185 R, 160, 224, 279, 350
See application file for complete search history.

(56) References Cited

U.S. PATENT DOCUMENTS

| | | | | |
|---|---|---|---|---|
| 8,058,818 | B2 * | 11/2011 | Shiu et al. | 315/297 |
| 2007/0120506 | A1 * | 5/2007 | Grant | 315/312 |
| 2008/0185975 | A1 | 8/2008 | Chen et al. | |
| 2008/0297067 | A1 * | 12/2008 | Wang et al. | 315/294 |
| 2009/0212716 | A1 * | 8/2009 | Chen et al. | 315/294 |
| 2009/0237003 | A1 * | 9/2009 | Sormani et al. | 315/294 |
| 2010/0033109 | A1 * | 2/2010 | Liu et al. | 315/294 |

* cited by examiner

*Primary Examiner* — Jimmy Vu
*Assistant Examiner* — Henry Luong
(74) *Attorney, Agent, or Firm* — Kilpatrick Townsend & Stockton LLP; Kenneth R. Allen

(57) ABSTRACT

A digital control mechanism is provided to maintain current matching of a plurality of LED devices where the conventional supply voltage may be insufficient to achieve the threshold working current.

7 Claims, 11 Drawing Sheets

Figure 6

| | Sample | | Action |
|---|---|---|---|
| | S1 Nominal | S2 Higher | |
| Error Signal | No | No | Increase output current (up to programmed setting) |
| | No | Yes | Stay at present output current value |
| | Yes | X | Reduce output current |
| X = Don't Care | | | |

Figure 8

| | Sample | | | Action |
|---|---|---|---|---|
| | S1 Nominal | S2 Higher | S3 Lower | |
| Error Signal | No | No | X | Increase output current (up to programmed setting) |
| | No | Yes | X | Stay at present output current value |
| | Yes | Yes | No | Reduce output current |
| | Yes | X | Yes | Reduce output current - larger step |
| X = Don't Care | | | | |

SYSTEM AND METHOD FOR UNIFORM CONTROL OF CURRENT REGULATED OUTPUTS OVER WIDE VOLTAGE RANGES

CROSS-REFERENCES TO RELATED APPLICATIONS

Not Applicable

STATEMENT AS TO RIGHTS TO INVENTIONS MADE UNDER FEDERALLY SPONSORED RESEARCH AND DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates generally to semiconductor integrated circuit (IC) technology. In particular, the invention relates to a unique semiconductor circuit used for wide-range low-dropout current regulation.

In known electronics designs, power control includes voltage or current regulation. One popular example that requires constant current control is the light-emitted-diode (LED) controller application. As a lighting source, an LED unit is required to work with a wide range of brightness, which is proportional with the forward current going through the LED unit. For this reason an LED unit 10 is often driven by a constant current regulator 12 as indicated in FIG. 1.

Many applications require multiple LED units 14, 16, 18 (FIG. 2) to achieve the required brightness and/or distribute the light over a larger area. When all the LED units are placed in series, the LED currents are the same, and the brightness of each LED is therefore also the same. However, as multiple LED units are added in series, the voltage required to drive the LED unit chain is increased. This often requires a step-up voltage converter in order to obtain a sufficiently large enough working voltage. Adding a step-up converter adds to the system cost and degrades efficiency and is not always the preferred solution. Hence there is often a need to drive multiple LED units, or multiple strings of several LED units in series, in a parallel manner. Unfortunately the forward voltage drop of LED units is not well controlled across temperature, LED color, or even from unit to unit and therefore placing LED units in parallel results in poor current matching in the LED units, or LED strings. Hence the preferred way to drive multiple LED units or LED strings is using a separate current regulator (for example a gain/attenuator block 20, 22, 24) in connection with error amplifiers 26, 28, 30 controlling output MOSFETS 32, 34, 36 for each of the parallel chains to ensure the current as seen at current sense resistors 38, 40, 42 through each LED unit 14, 16, 18 is tightly controlled, as indicated in FIG. 2.

In some LED lighting source applications the overall light color is generated by a combination of different LED color units, often Red, Green, and Blue (RGB). This allows control of the chromatic hue or while balance of the resulting light. Different color LED units often have different current requirements and working forward voltages, thus making tight current control of each of the LED colors important and the use of multiple current regulated outputs mandatory. The current in each channel can be independently controlled by adjusting the effective value of the current sense resistor and/or changing the amount of gain or attenuation applied to the non-inverting input of the Error Amplifier.

When there is sufficient supply voltage, there will be enough voltage to maintain the correct forward voltage for the LED unit (or units) and a large enough voltage headroom across the current regulating circuit for it to function correctly. (In this case, headroom can be defined as the drain to source voltage of the output MOSFET.) However, as the supply voltage decreases the voltage headroom across the current regulator output can eventually be reduced to a value that prevents the current level from being maintained. Then the current will start to decrease as the supply voltage is further decreased. The point at which regulation is lost will be dependent on the forward voltage of each LED unit, and since this is not well-controlled, the matching of the currents for the different LED units will be lost under low headroom conditions. As regulation is lost, the brightness of the various LED units will differ and unevenness will appear across the display and/or a change in color will also appear if RGB LED units are used. Both effects are undesirable and in current practice the LED units need to be switched off in time to prevent such effects occurring.

What is needed is a better way to sense and control output of an array of LED units.

SUMMARY

According to the invention, a digital control mechanism is provided to maintain current matching of a plurality of LED devices where the conventional supply voltage may be insufficient to achieve the threshold working current.

The invention will be better understood by reference to the following detailed description in connection with the accompanying drawings.

BRIEF DESCRIPTION OF THE DRAWINGS

FIG. 6 is a logic table for a digital control loop according one aspect of the invention.

FIG. 8 is a logic table for a digital control loop according to a further aspect of the invention.

DETAILED DESCRIPTION OF THE INVENTION

Figure 1:
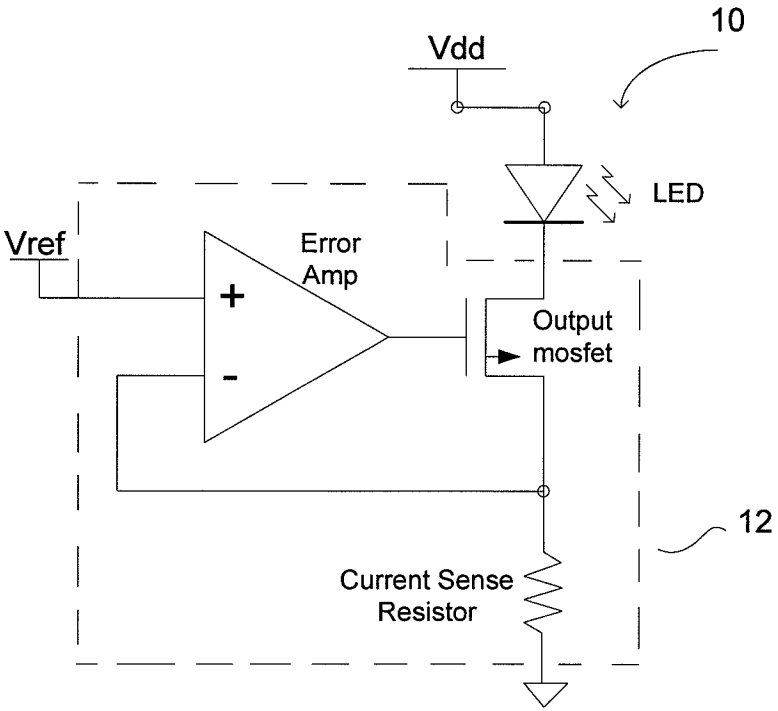
Figure 1 (PRIOR ART)
FIG. 1 is a circuit diagram of a prior art LED driver circuit for a single LED device.
Figure 2:
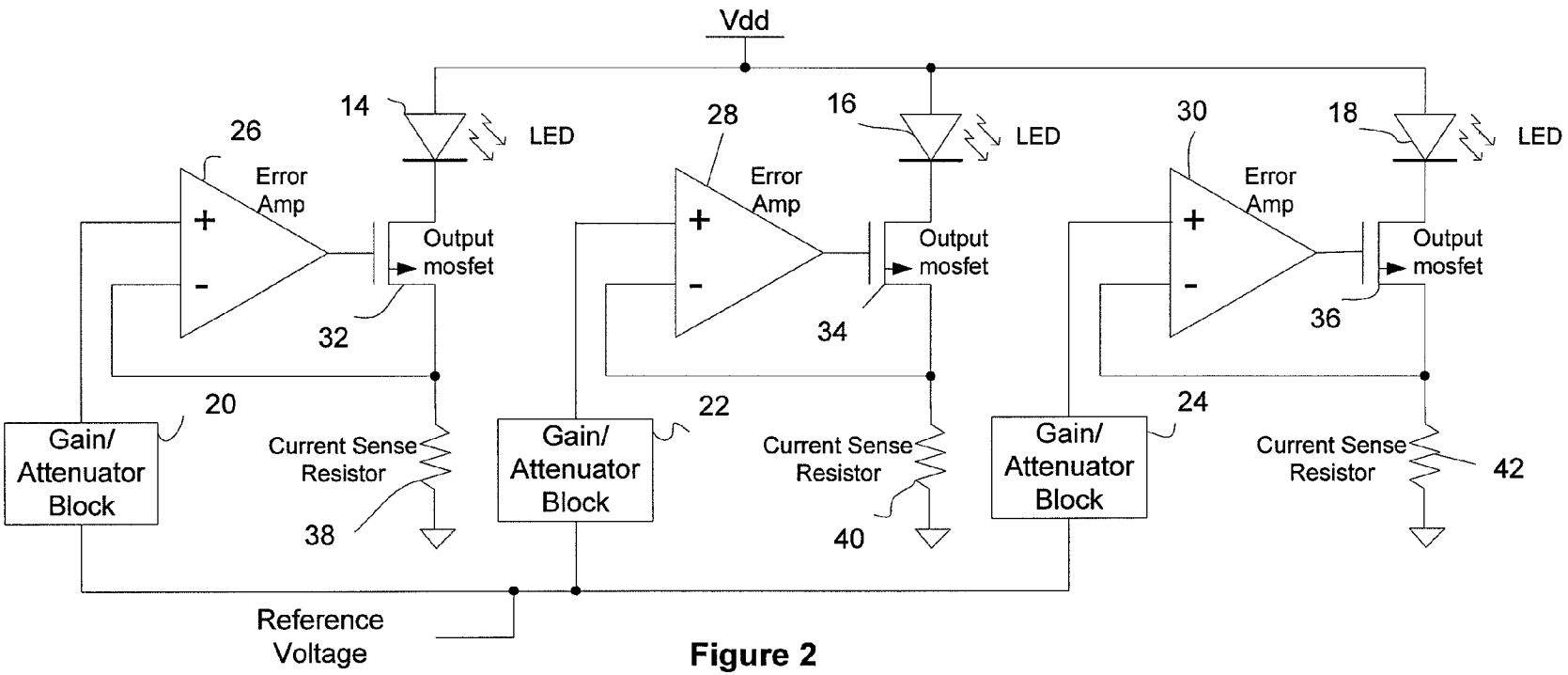
Figure 2 (PRIOR ART)
FIG. 2 is a circuit diagram of a prior art LED driver circuit with regulators for a multiple LED device.
Figure 3:
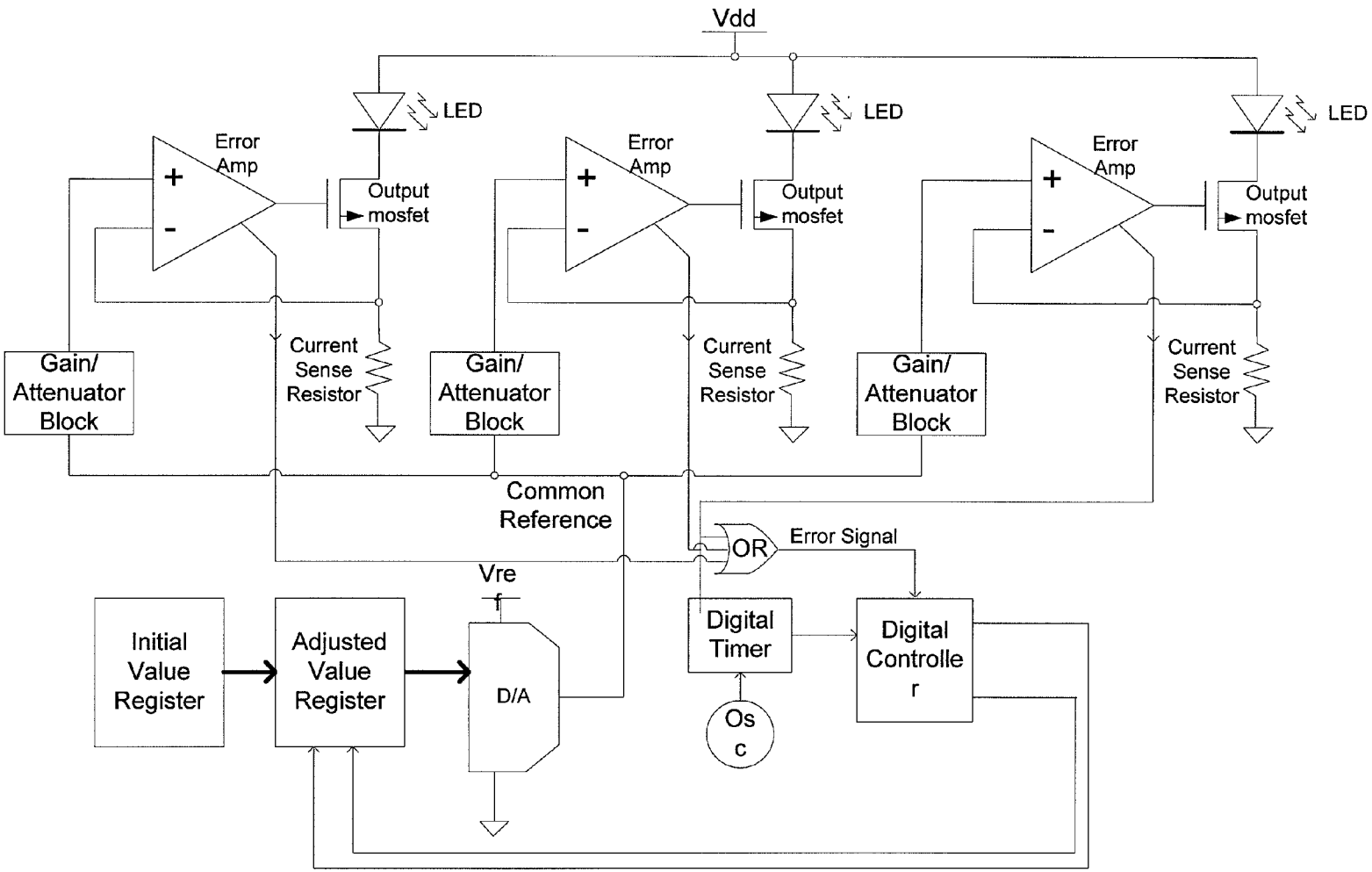
FIG. 3 is a schematic circuit diagram illustrating the circuit according to an embodiment of the present invention.

FIG. 3 is a schematic circuit diagram illustrating the circuit according to the typical embodiment of the present invention.

In the indicated embodiment of the invention there are three independent channels, each comprising a current sense resistor, output MOSFET, an error amplifier, and the external LED unit. The method applies equally well to any number of channels from two or more. Also the current sense resistor could also be a MOSFET device working in, or close to, its resistive region. Each unit shares a common supply voltage, $V_{dd}$, and a common reference voltage. The error amplifier compares the reference voltage with the voltage developed across the current sense resistor, and adjusts the output MOSFET gate voltage so that the two values are matched. Using this method the current through the LED unit is accurately controlled.

In general each channel need not have the same output current and each current can be set independently by either adjusting the effective value of the current sense resistor, or by adjusting the percentage of the reference value utilized by each channel error amplifier, or by a combination of both methods.

When the supply voltage is lowered, the headroom voltage across the output MOSFET is reduced and the error amplifier will increase the output MOSFET gate voltage to try and maintain the correct current value. At some point the gate drive for the output MOSFET will reach a maximum, usually the supply voltage of the error amplifier output stage, and at that point the output stage is said to be saturated and regulation will be lost.

Figure 4:
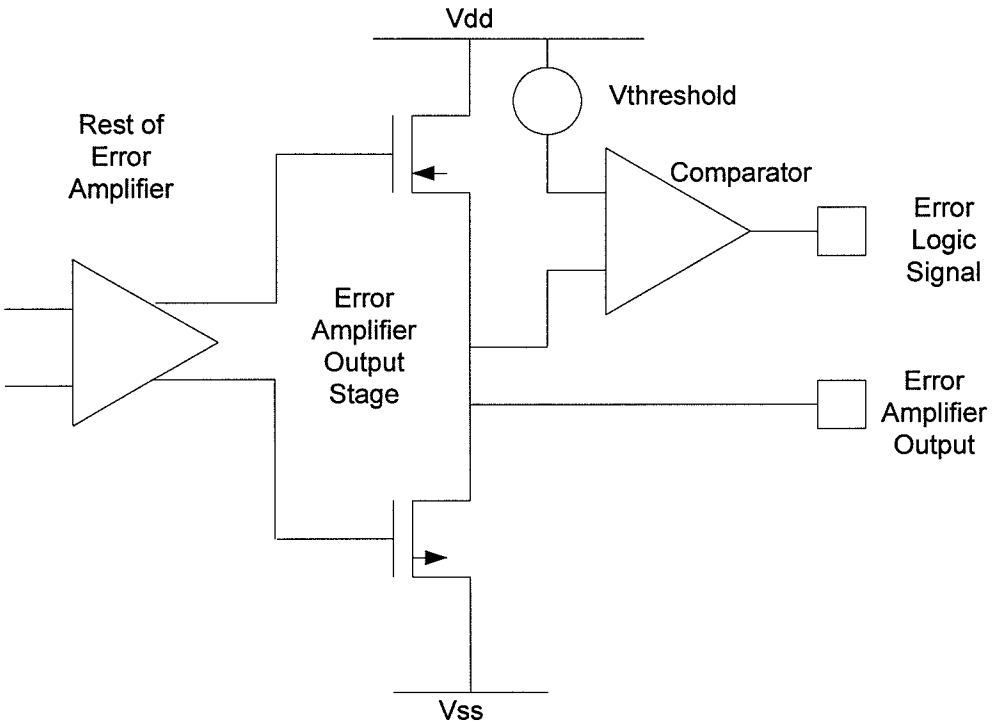
FIG. 4 is a saturation detection circuit according to an embodiment of the invention.

In the preferred embodiments according to the invention, the current invention adds a saturation detection system to the error amplifier that provides a logic output signal that goes active just before the error amplifier loses regulation. An example of such a saturation detection circuit is indicated in FIG. 4.

Each channel will produce a saturation detection logic signal that is logically ORed and used to provide a composite error signal for the rest of the control logic block. If the error logic signal is active, then one or more of the outputs is close to, or in, saturation. The digital controller then acts to vary the value of the current sense resistor (FIG. 3). This may for example lower the reference voltage to or lower the current through ALL of the LED channels until all of the Error Amplifiers indicate that they are no longer in saturation and are therefore regulating normally. By using this method the LED units are dimmed by the same ratio maintaining a uniform display brightness and/or color.

The digital controller needs to monitor and control the output currents on a regular or continuous basis to ensure that the LED units are running at the maximum brightness possible up to a maximum preset value. This monitoring is only necessary once the digital controller has taken control of the effective reference voltage (or current) to each channel. Once all channels are working at the intended full current value, and the Error Amplifier error signals remain not active, the digital controller no longer regulates the brightness of the display.

Figure 5:
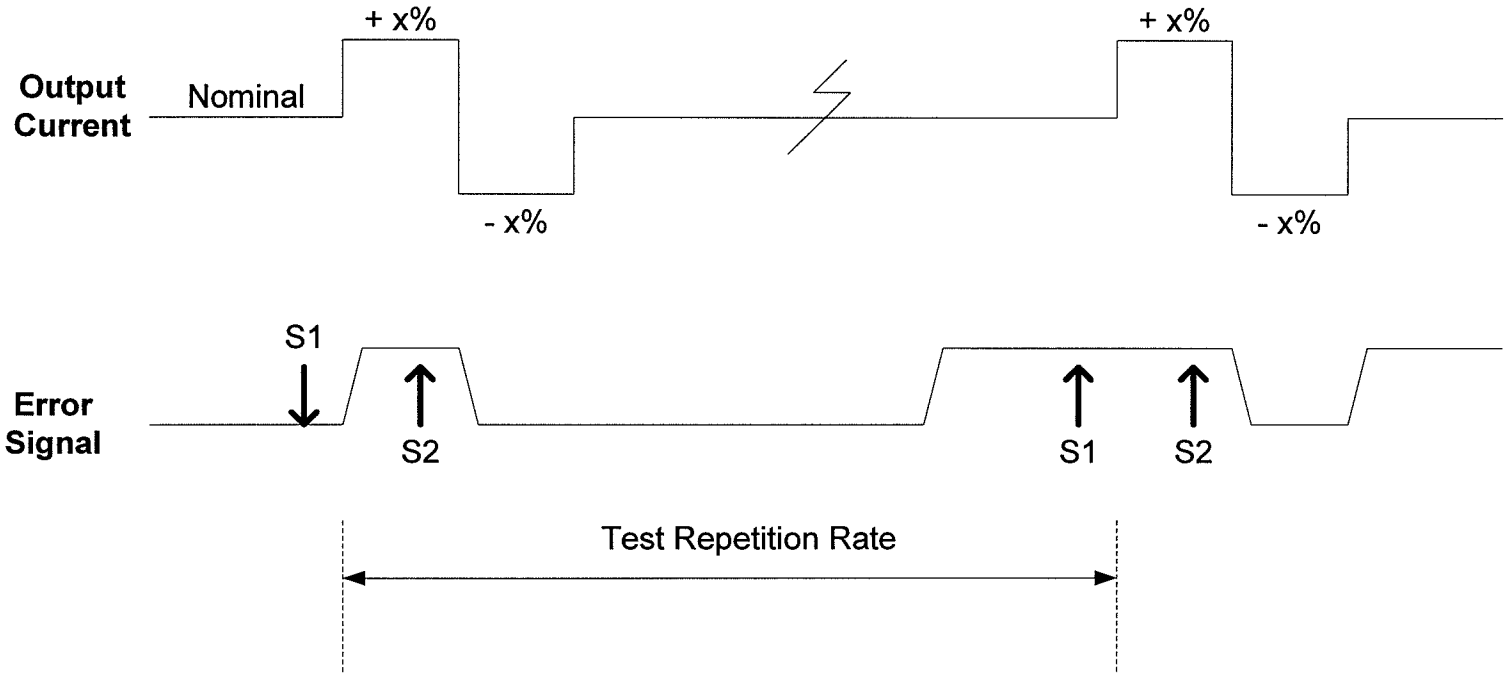
FIG. 5 is a waveform diagram of a digital control loop according one aspect of the invention.

The operation of the digital control loop is indicated by the waveforms in FIG. 5 and the control table in FIG. 6.

The digital control loop is stabilized by storing and comparing two different error signal results at different current levels at a regular rate. The order in which the sampling occurs is not important for the operation of the digital loop and the negative excursion is not required but is the preferred solution to minimize current level disturbance in the LED units. As indicated in this implementation the voltage reference is initially increased slightly, then decreased slightly, and then returned to the initial value. The least disturbance is caused when the amount and duration that the reference value is decreased matches the amount and duration that it was increased by so that the time averaged value is equal to the nominal value. If the tests are performed quickly enough the resulting small display brightness flicker caused by the intended current variations will not be seen. The negative excursion is not a requirement and could be omitted if the resulting average value disturbance caused by the reference increase pulse is not significant. The combined error signal is sampled towards the end of the high reference value and stored as sample S2. The combined error signal is also sampled just before (as indicated), or some time after, the intended disturbance and stored as the nominal sample S1.

The two samples are then compared as indicated in the table of FIG. 6 and the resulting action taken. By this method the digital control loop is continuously adjusting the reference to each channel to maintain the maximum possible current just sufficient to ensure regulation at the given supply voltage.

The tests could be performed continuously but in general this is unnecessary as the supply voltage generally does not vary very quickly. Therefore the tests could be repeated at a lower rate indicated by the Test Repetition Rate in FIG. 5.

Figure 7:
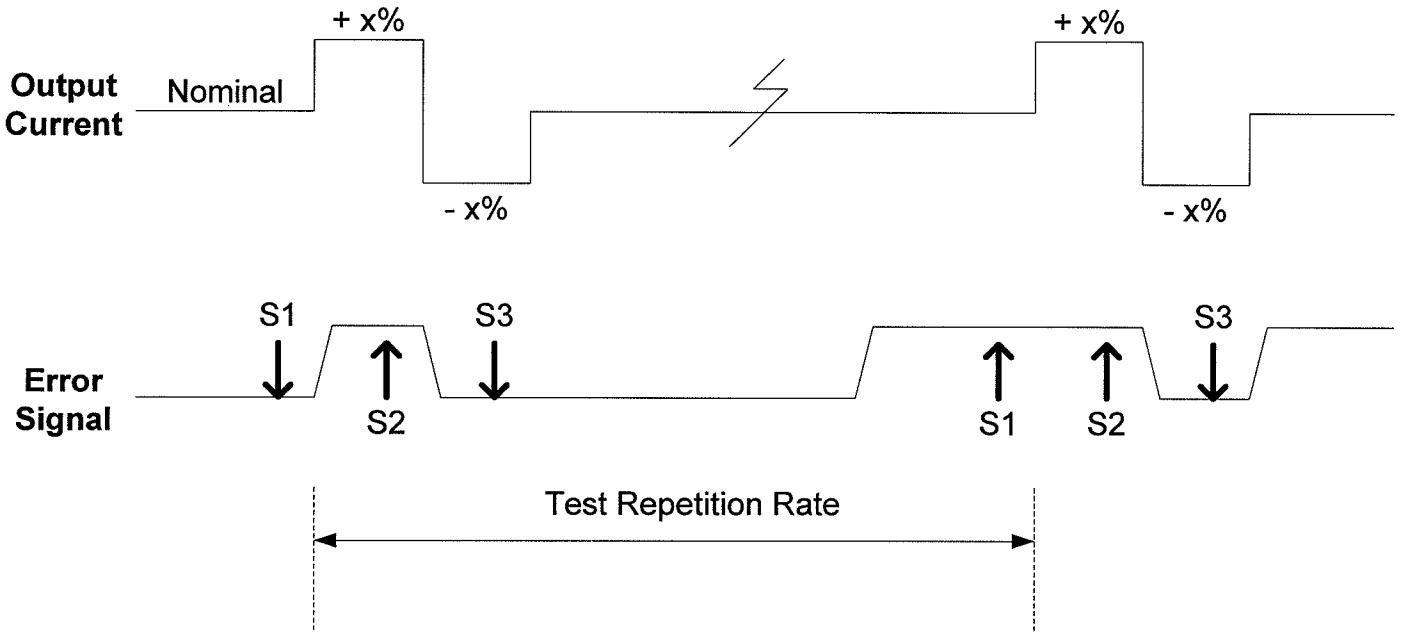
FIG. 7 is a waveform diagram of a digital control loop according to a further aspect of the invention.

The sampling as shown in FIG. 5 could be extended to also sample at the negative excursion as indicated in FIG. 7, sample S3. The resulting decision table is given in FIG. 8. This extra sample information allows faster reduction rates in the output currents and can thereby improve response times.

Another potential enhancement of the circuit is to add a digital dip detector to the existing circuit by allowing an instant reduction in the output current should one of the current outputs saturate but require multiple clear signals (i.e., all samples result in no active error logic signal) before returning to a higher current setting. This function can be readily implemented by adding a resettable counter, or some such similar circuit, placed after the sampled data signal. The count of the resettable counter is increased at each active sampled error signal and reset at every non-active sampled error signal. Only if the counter receives a preset number of sequential active error signals does the counter output go active and cause the current setting register to increment the output current setting. The current setting register then continues to increment until an active error signal is sampled or the maximum setting is obtained.

Figure 9:
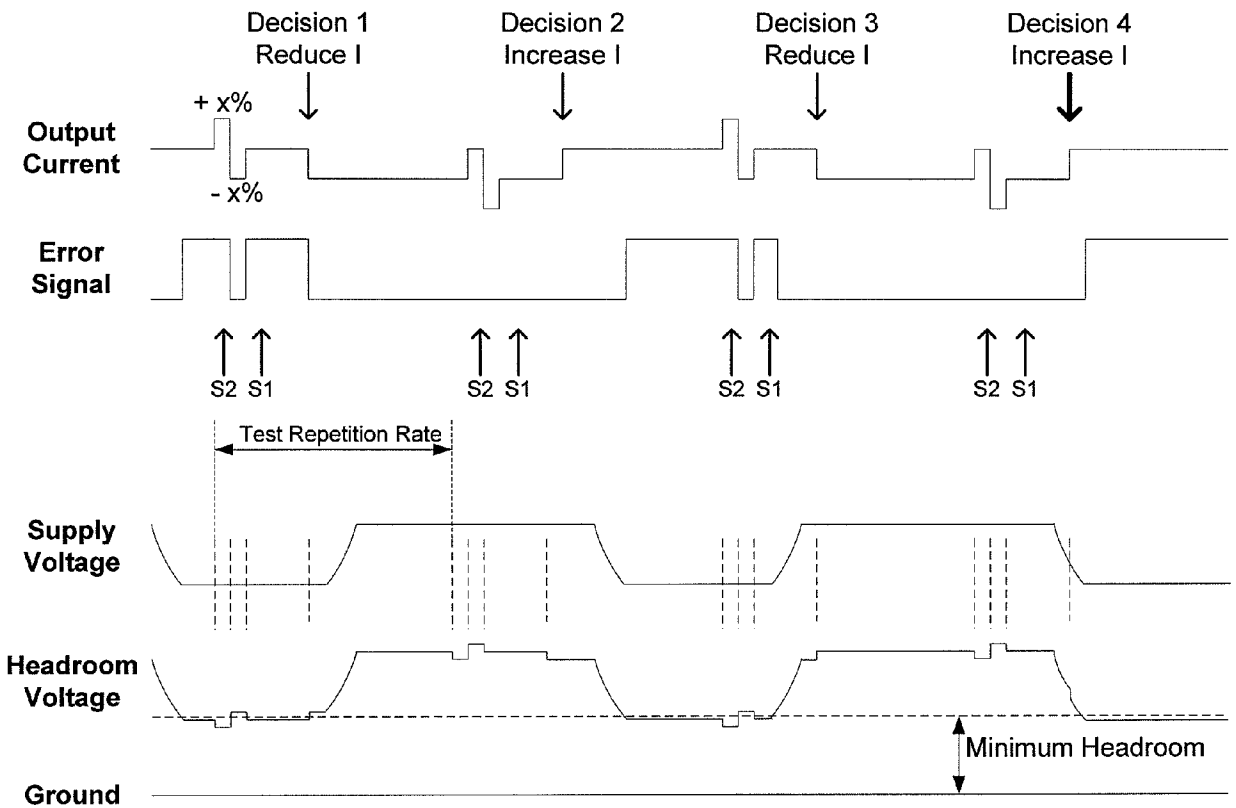
FIG. 9 is a waveform diagram that shows response of a digital control circuit without a digital dip detector.
Figure 10:
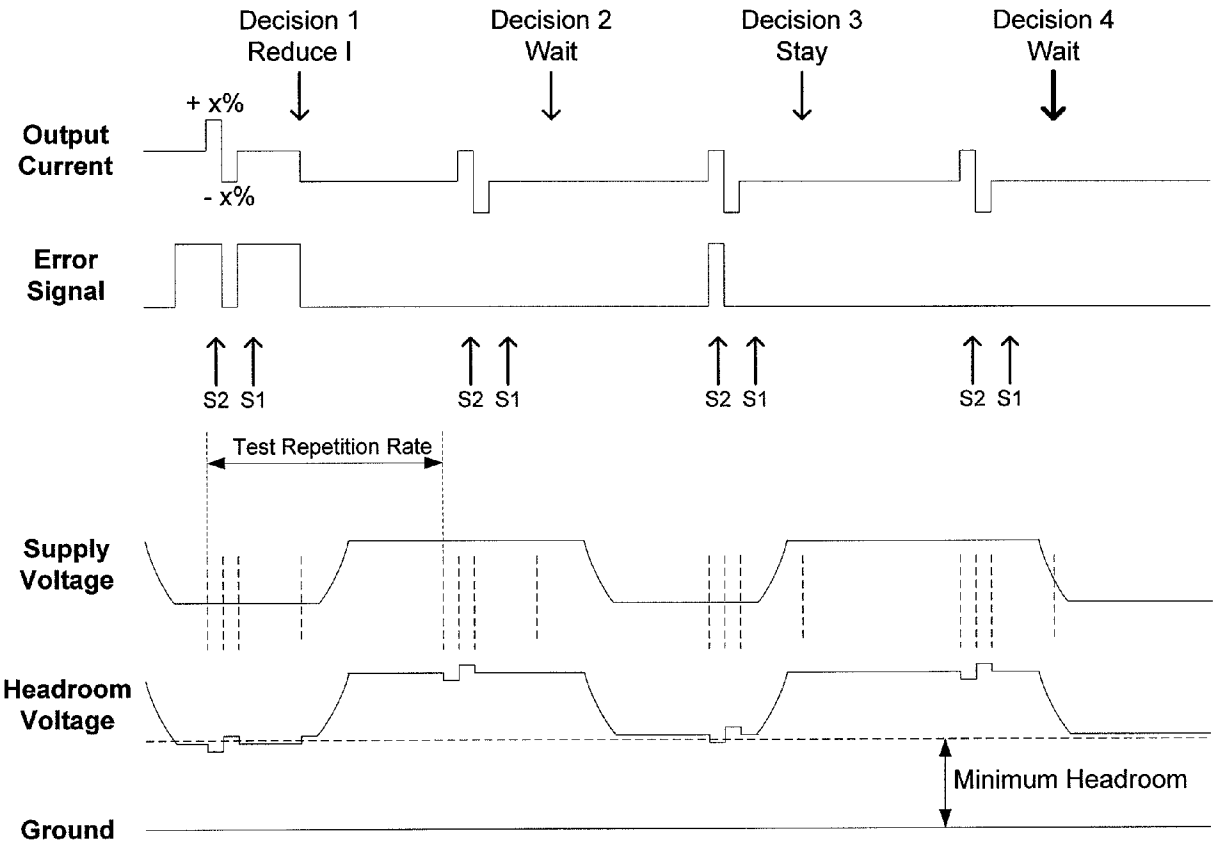
FIG. 10 is a waveform diagram that shows response of a digital control circuit with a digital dip detector according to the invention.

The resulting asymmetric nature of the digital control loop will enable the outputs to regulate better in the presence of noise or frequent supply voltage dips such as when the circuit is attached to a battery used with a GSM RF transmitter module. FIGS. 9 and 10 indicate the potential benefit of such a scheme. FIG. 9 shows the response of the circuit without the digital dip detector and clearly indicates that the headroom for the output MOSFET is sub-optimal during the power supply dips due to the fact that the current level is restored during the nominal operating voltage between the power supply dips. FIG. 10 shows the response of the circuit with the digital dip detector and indicates that the headroom of the output MOSFET is kept to an optimum setting once the loop has stabilized. Since the repetition rate of the worst power supply dips are usually known (such as with GSM polling cell phone applications) the sampling repetition rate and the number of wait cycles before increasing the current setting can be optimized for a given application.

Figure 11:
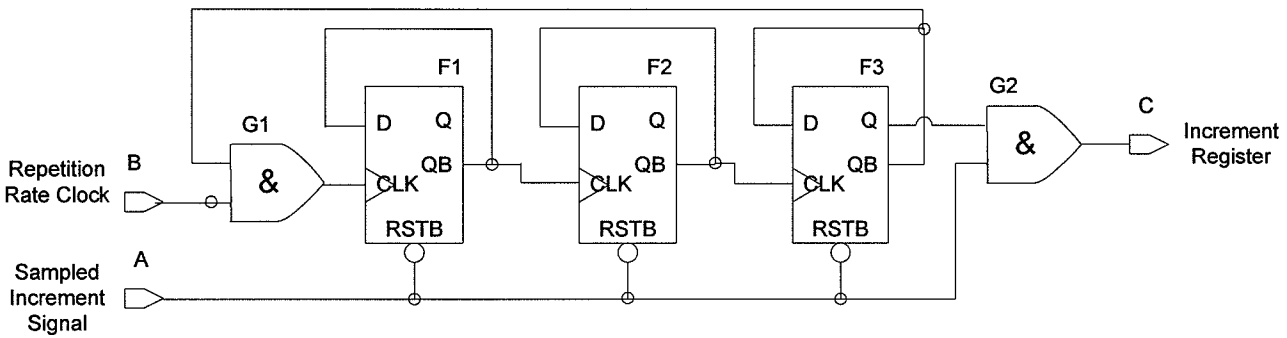
FIG. 11 is a schematic circuit diagram illustrating a resettable counter that enables the invention to operate as a digital dip detector.

Referring to FIG. 11, the dip detector comprises a counter (F1, F2, and F3) with a reset function and a gated clock input (G1). The counter is reset if the signal at input A is at any time not active high. Input B provides the clock to the counter and the gate G1 inhibits the counter from counting beyond the point where the last Flip-Flop (F3) changes state. The output of the counter is also gated with the signal at input A so that an active high output signal can only occur if the input A is active high and the counter has reached a final count value indicated by the Q output of F3 going high. Thus the signal at output C will only be active high if the input A has been continuously high for at least the length of time for the counter to increment the Q output of F3. The output C will then remain high as long as input A is high and will go low immediately after input A goes low. In the digital dip detector the sampled increment signal is present at input A and the increment register signal is derived from output C. Hence the register controlling the output current will only increase after a continuously active sampled increment signal indicating that there are no error signals from the error amplifiers during that period of time.

The present invention may be embodied in many different forms, designs or configurations, for the purpose of promoting an understanding of the principles of the invention, reference has been made to the embodiments illustrated in the drawings and specific language used to describe the same. It will nevertheless be understood that no limitation of the scope of the invention is thereby intended. Any alterations and further implementations of the principles of the invention as described herein are contemplated as would normally occur to one skilled in the art to which the invention relates. The skilled artisan will appreciate that modifications and adoptions to those embodiments may be made without departing from the scope and spirit of the present invention, which is only to be limited as indicated by the appended claims.

What is claimed is:

1. A control system to maintain a uniform brightness across a plurality of LED output channels each employing individual current sources comprising:

a device for making a sampled comparison of error signals derived from individual error amplifiers associated with each said LED output channel and in response to the error signals: and a controller for making adjustments to individual currents supplied to each said LED output channel in response to the error signals to steer current toward producing uniform LED brightness, wherein a digital control loop is modified to reduce a rate increase of an output current compared to a rate decrease of the output current to allow a circuit to regulate better in presence of noise or frequent power supply dips.

2. A control system according to claim 1, wherein the individual input sources are of unregulated voltage.

3. A system according to claim 1 wherein said device includes a current controller and at least one current sense resistor, the current controller being configured to make adjustments for varying value of said at least one current sense resistor.

4. A system according to claim 1 wherein three samples are made to further improve resultant operating LED current level.

5. A method to control LEDs and to maintain a uniform brightness across multiple LED channels using individual current sources comprising:

making a sampled comparison of error signals derived from error amplifiers associated with each output channel; and adjusting current through the LEDs in response to the error signals to steer current toward producing uniform brightness, wherein the individual input sources are of unregulated voltage, and wherein a digital control loop is modified to reduce a rate increase of an output current compared to a rate decrease of the output current to allow a circuit to regulate better in presence of noise or frequent power supply dips.

6. A method to control LEDs and to maintain a uniform brightness across multiple LED channels using individual current sources comprising:

making a sampled comparison of error signals derived from error amplifiers associated with each output channel; and adjusting current through the LEDs in response to the error signals to steer current toward producing uniform brightness, wherein a digital control loop is modified to reduce a rate increase of an output current compared to a rate decrease of the output current to allow a circuit to regulate better in presence of noise or frequent power supply dips.

7. The method according to claim 6 wherein three samples are made to further improve resultant operating LED current level.

* * * * *